United States Patent [19]

Gach

[11] Patent Number: 4,815,618

[45] Date of Patent: Mar. 28, 1989

[54] TAMPER INDICATING DISPENSER CLOSURE

[75] Inventor: Peter P. Gach, Evansville, Ind.

[73] Assignee: Sunbeam Plastics Corporation, Evansville, Ind.

[21] Appl. No.: 185,909

[22] Filed: Apr. 25, 1988

[51] Int. Cl.[4] ..... B65D 41/34

[52] U.S. Cl. ..... 215/232; 220/258

[58] Field of Search ..... 215/232, 235, 250; 220/258

[56] References Cited

U.S. PATENT DOCUMENTS

| | | | |
|---|---|---|---|
| 2,387,955 | 10/1945 | Tilson . | |
| 4,320,861 | 3/1982 | Rieke | 222/541 |
| 4,378,894 | 4/1983 | Willis et al. | 215/252 |
| 4,512,486 | 4/1985 | Kobayashi | 215/249 |
| 4,572,397 | 2/1986 | Arens | 220/270 |
| 4,605,136 | 8/1986 | Debetencourt | 215/232 |
| 4,747,498 | 5/1988 | Gach | 215/232 |
| 4,754,890 | 7/1988 | Ullman et al. | 215/232 |

*Primary Examiner*—George T. Hall

*Attorney, Agent, or Firm*—Irvin L. Groh; Alfred L. Patmore, Jr.

[57] ABSTRACT

A tamper indicating closure has a hermetically sealed membrane which prevents contamination. The membrane is held within a closure cap for easy application to a container neck prior to being heat welded to the container. A disc secured to the membrane together with a pull ring serves to sever the membrane and open the sealed container. A lid functions to cover the membrane and disc until the seal is to be broken and thereafter to close the container when not in use. The only way to gain access to the contents, i.e. to the interior of the container, is by tearing the membrane. The means for tearing the membrane substantially covers the membrane except for a very thin edge portion thereof adjacent the spout of the container. This insures that tearing for the purpose of opening will substantially completely remove the membrane and also insures that access to the membrane for tampering purposes is very difficult.

15 Claims, 1 Drawing Sheet

Fig-1
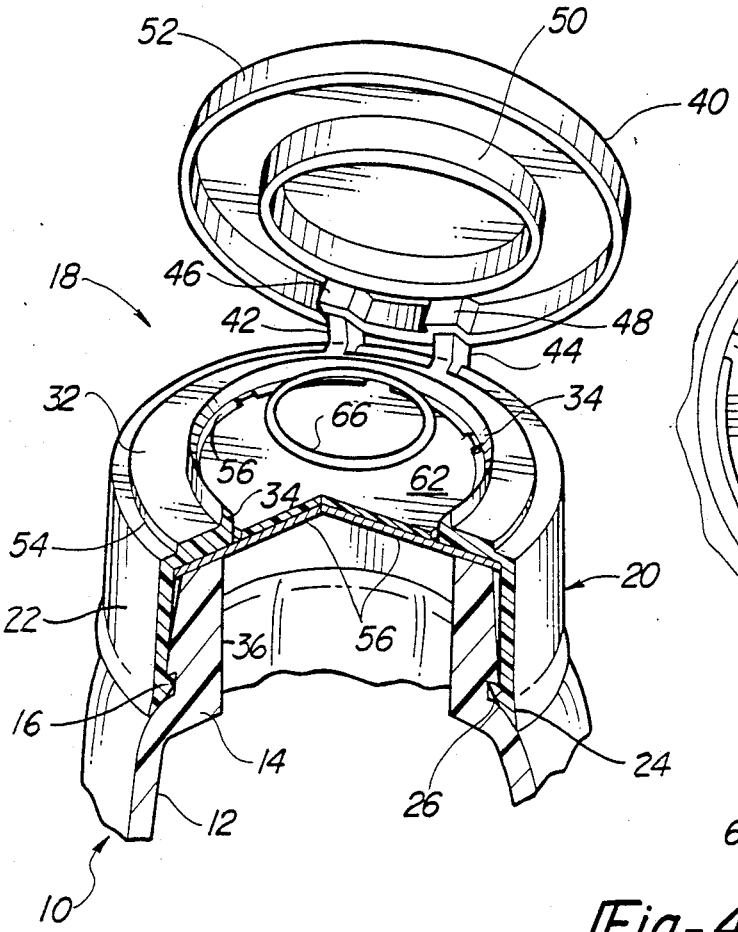
Fig-2
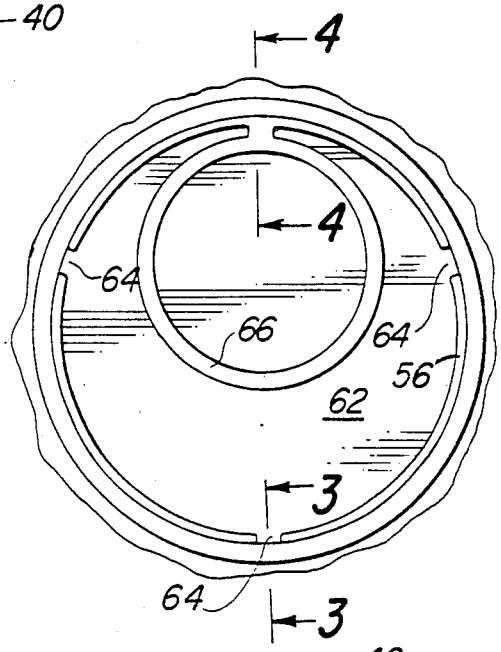
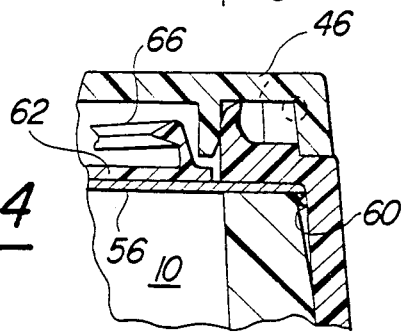
Fig-4
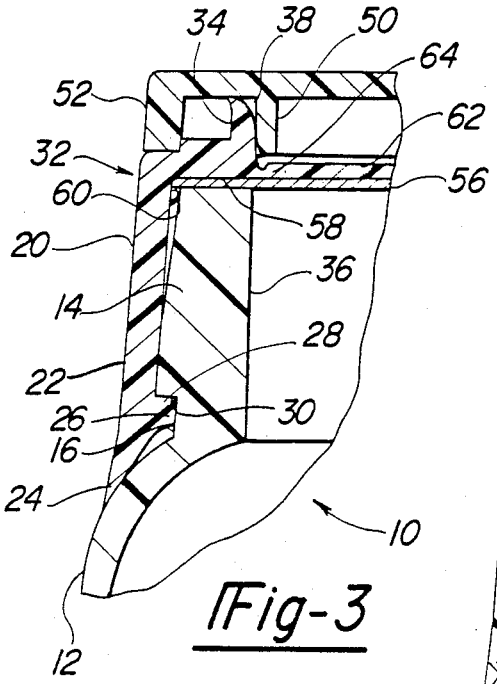
Fig-3
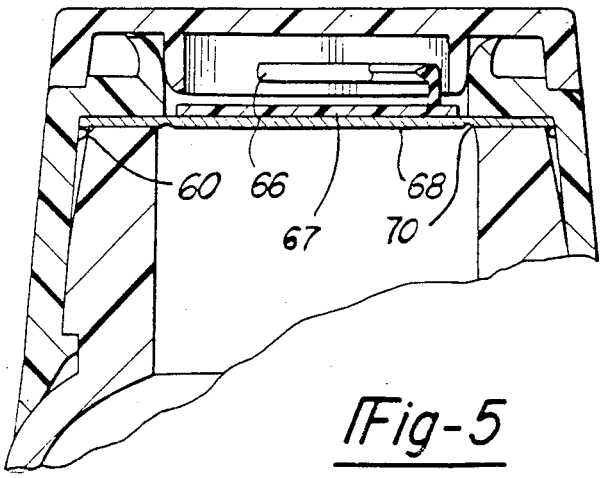
Fig-5

TAMPER INDICATING DISPENSER CLOSURE

BACKGROUND OF THE INVENTION

I. Field of the Invention

This invention relates to closures for containers which provide some means for indicating if the container has been opened or tampered with. Such indicators are particularly useful for containers for non-perscription drugs and other consumable products which may be ingested or otherwise applied to the user. The tamper indicating means serves to alert a prospective user as well as store personnel that an attempt has been made to tamper with the product in a container.

II. Descriptoin of Prior Art

Many types of indicators and arrangements of container closures have been proposed to warn of tampering of containers for medicine and other products such as are usually available "on the shelf", of pharmacies, grocery stores, etc.

In some instances metallic covers have been pressed onto the containers and extended over the typical covers normally opened and closed in dispensing the material within the containers in everyday use. To reach the inner cover the metallic cover must be destroyed or at least be so damaged as to present a marked difference from its usual or normal appearance. Such a difference in appearance will serve to warn of possible tampering.

In other instances sections of a cover like closure for the container are secured to other portions of the closure in such a manner that entry to the container requires breaking of a section of the cover.

In yet other instances interior and exterior members of a closure system interfit in such a manner that relative movement between the two is required in order to gain access. However, any such movement results in disfigurement and partial opening of an exterior member in a manner that will be clearly discernable by a prospective purchaser. Some tamper indicating closures employ upper outer sections which are secured to other portions of a cap or the like along weakened tear lines, and include ring like members which can be grasped to rip the outer section away along the tear lines thus exposing the contents or an inner cover member.

SUMMARY OF THE INVENTION

The invention provides a closure which will hermetically seal a container, is of relatively simple construction, is easily placed on the container yet will provide a clear indication of any tampering. The invention also provides a hermetically sealed container closure with a pull ring for breaking the seal.

The invention utilizes a foil seal which can be heat sealed to the container after the closure is in place and which provides an entry seal which must be removed in order to gain access to the interior. The foil seal is positioned within a cap member which is force fitted to the container neck or the like. The foil member is easily placed in proper position by the placement of the cap, and the unit can be supplied as a single unitary structure for ease of handling, shipping and application. The closure further includes a disc member which is secured to the foil member inwardly of a ring like section of the foil which is applied to the container neck. The disc member may be integral with the cap base or separate therefrom. In either event it functions in the opening of the container by providing means for tearing the foil seal. A lid cooperable with a funnel like opening in the cap overlies and normally protects the foil seal. The lid also functions as the container closure means after the foil has been removed and in the normal use of the products contained in the bottle.

Further there is provided a preassembled closure unit which is readily applied to a container neck wherein the base of the unit supports both the hermetically sealable member, the means for breaching the seal, and a spout like opening for ease of dispensing contents, together with a closure lid which cooperates with the spout for use in closing and opening the container during normal use after the hermetic seal is broken.

In addition the closure does not require any components which occupy space within the container neck after opening. Thus the passage outwardly from the container is unrestricted by the clousre structure.

These and other advantages will become more apparent from the following description and the accompanying drawings.

BRIEF DESCRIPTION OF THE DRAWINGS

FIG. 1 is a perspective view, partly sectioned of a container neck with a closure according to the invention and also showing a partially open lid thereon.

FIG. 2 is a fragmentary top view of the closure of FIG. 1 on a slightly larger scale and without the lid thereof.

FIG. 3 is a section taken along line 3—3 of FIG. 2.

FIG. 4 is a section taken along line 4—4 of FIG. 2.

FIG. 5 is a vertical section showing a second form of the invention.

DETAILED DESCRIPTION OF THE PREFERRED EMBODIMENT OF THE INVENTION

Referring now to FIGS. 1–4:

Container 10 has a typical side wall 12 which tapers into an open cylindrical neck 14. A circumferential recess 16 extends around the neck. Closure 18 is mounted on the neck. Closure 18 comprises a base 20 which includes a depending skirt 22. The skirt has a tapering lower end 24. The skirt also has an inner circumferential flange 26 which is received within recess 16. The flange has an upper surface 28 which firmly engages the facing surface 30 of recess 16. Base 20 includes an upper radially inwardly projecting section 32 which extends when assembled with the container inwardly over the upper lip of neck 14.

Section 32 has an inner upwardly extending nozzle or funnel 34 which extends circumferenitally above and substantially in vertical alignment with the inner surface 36 of container neck 14. The nozzle bevels outwardly towards its upper end as shown at 38. This functions to improve its funnel like effect which assists in dispensing material from within. In addition it serves to facilitate closing of the lid 40. Lid 40 is shown to be pivotally mounted on posts 42 and 44 in the manner shown in U.S. Pat. No. 4,682,702. As disclosed in the latter patent posts 42 and 44 have abutments which snap into recesses in the channels 46 and 48 to provide the hinge action. Other forms of hinges may be used such as a living hinge in which the base, the lid and the hinge are integrally molded. The lid has an inner depending circular rim 50 which is sized to closely fit the nozzle 34 and forms therewith the means for closing the container. The lid also has a peripheral rim 52 which frictionally engages rim 54 on base 20 sufficiently tightly to form a retaining means for retaining the lid in closed position.

A disc like impervious foil liner-seal 56 extends substantially completely across the inner chamber formed by skirt 22 immediately adjacent the lower plannar surface 58 of upper section 32 of base 22 and extends across and closes spout or funnel 34. A peripheral inner flange or bead 60 is spaced downwardly from surface 58 a distance such that when disc seal 56 is placed within the peripheral recess thus formed between flange 60 and surface 58 the disc will be retained in this position. Further skirt 22 is dimensioned such that when the skirt is forced into recess 16, the disc will be firmly in contact with surface 58 and the lip of neck 14.

The closure 10 is completed by a disc 62 which bears against the upper surface of foil liner-seal 56 and is integrally connected to section 32 by a series of breakable webs 64, preferrably three in number 120° apart, as illustrated. As shown the webs are relatively short in length and between the webs the disc 62 extends circumferentially to immediately adjacent the inner face of spout 38, see FIG. 4. Thus there is minimal space between the disc 62 and base 20. The webs are also narrow as shown in FIG. 2 and thus are easier to break them if they were relatively wider. A pull ring 66 is attached to disc 62 and fits within the lid 46.

The foil liner is coated with a heat sealing compound which can be of the same composition as the base cap. Thus a polypropylene compound could be used where the base 20 is formed of polypropylene. The compound is applied to both sides of the disc shaped liner along its rim, so that it contacts the neck of the container and the surface 58 of sections 32 of base 20, and is also so applied to the side of the liner facing disc 62. After the closure is placed onto the filled container the foil coating is heated by an induction coil sufficiently to weld the foil to the disc 62, the lower face of section 32, and the lip of neck 14. This welding hermetically seals the container. To open the container the lid is opened and then the ring is grasped and pulled. Pulling on the ring will break the webs and thus break the disc 62 from the base 20 and tear the foil along the opening between the disc 62 and the spout 34. With the disc lying immediately adjacent spout 34, the portion of the foil liner inwardly of spout 34 will be substantially entirely removed and will not create an obstruction within the spout.

FIG. 5 shows a second form which the invention may take. In this instance the disc 67 is of the same construction as disc 62 except that it is not joined to base section 20. Instead it rests on and is supported by a liner 68 of the same general form and construction as liner 56. In this case however, the liner must be strong enough to support disc 67 and its associated pull ring. The liner may be provided with a circumferential score line 70 to facilitate tearing at the edge of the inner surface of the funnel. The disc 67 approaches closely to the spout thus insuring that substantially all the foil will be removed. A bead 60 holds the foil liner in position until assembly with the container.

The foil in either case is sealed to the container. The only way to obtain access is by destruction of the foil liner. The closeness of the disc to the spout leaves a very narrow opening which further deters tampering.

With the sealing liner member the container is more easily sealed against leakage and ingress of fluid than if gaskets are employed.

Another advantage of using a foil seal is that the base member and lid can be of relatively high density material yet the member to be torn open, the seal, can be easily broken loose since it is made of relatively thinner easily torn material. The base member can be of material such as polypropylene which will be marred if one, for example, attempts to pry the base loose from recess 16 at the tapered lower end 24 of skirt 22. If made of a softer more plyable material the base member would be easier to pry and less likely to show markings caused by prying. The disc 62 as well as the lid 40 also can be of different material than the base and formed separately if desired as indicated above.

Another advantage achieved by the invention is that a one piece unit is provided yet the disadvantages of having to compromise on materials is avoided. The base and the liner can be formed of different materials yet with the seal liner secured to the base member by flange or bead 60 the closure units can be handled as complete, ready to apply units which can be positioned on the container in one motion. This simplifies distribution and assembly.

The embodiments of the invention in which an exclusive property or privilege is claimed are defined as follows:

1. A container closure comprising a base member having a depending skirt adapted to receive and engage a container neck;

said base member having a section forming an upwardly and inwardly opening spout, a foil seal, said seal closing the spout of said base member and contacting said base member outwardly of the periphery of said spout, means for hermetically securing said seal to said base member and to a container received by said base member, means inwardly of said spout and afixed to said seal for tearing the portion of said seal inwardly of said spout away from said closure to open said spout.

2. The container closure of claim 1 including means holding said seal within said base member comprising a bead on said base member.

3. The container closure of claim 1 including said means for hermetically securing said seal comprising a heat sealing compound.

4. The container closure of claim 1 including said means for tearing said seal comprising a pull ring.

5. The container closure of claim 1 including said means for tearing said seal comprising a disc member secured to said seal inwardly of said spout, means for moving said disc member to tear said seal inwardly of said spout.

6. The container closure of claim 1 including said means for tearing said seal comprising a disc attached to the upper surface of said seal inwardly of said spout, said disc extending circumferentially to immediately adjacent the inner face of said spout, and means for grasping said disc to tear the part of said seal inwardly of said inner face of said spout away from said spout.

7. The container closure of claim 1 including in a disc contacting the upper surface of said seal and connected thereto spaced webs connecting said disc to said base member, means for grasping said disc to tear part of said seal and said disc away from said spout.

8. The container closure of claim 1 including a disc attached to said seal inwardly of said spout and having means for grasping said disc to tear the inner part of said seal away from said spout, said disc being supported by said seal and approaching closely adjacent the inner face of said spout circumferentially thereof whereby said seal will be torn away substantially entirely along the inner wall of said spout.

9. The container closure of claim 1 including a lid connected to said base member for closing said spout and covering said seal within said spout.

10. A container closure for hermetically sealing a container and giving an indication of tampering comprising a base having a skirt shaped to conform to a neck of a container to be closed thereby, said base having an opening extending vertically therethrough and adapted for alignment with the container neck opening, a tearable seal closing said opening, said seal being held within said base and extending over a portion of said base adapted to be positioned in facing relationship with a container to be closed by said closure, said closure being designed to cause a close fit between said portion of said base, said seal, and the portion of the container facing said portion of said base, means for welding said seal to said portion of said base and said portion of said container, means for tearing the portion of said seal closing said opening from said closure.

11. The container closure of claim 10 wherein said means for welding said seal comprises a heat sealing compound.

12. The container closure of claim 10 including said means for tearing said seal comprising a disc positioned within said opening in said base and attached to said seal.

13. The container closure of claim 12 including said disc extending circumferentially to immediately adjacent the inner face of said opening.

14. The container closure of claim 13 including said means for welding said seal securing said disc to said seal.

15. The container closure of claim 14 including said disc being connected to said base by breakable webs.

* * * * *